US009913048B2

(12) United States Patent
Margalit

(10) Patent No.: US 9,913,048 B2
(45) Date of Patent: Mar. 6, 2018

(54) MEMS-BASED AUDIO SPEAKER SYSTEM WITH MODULATION ELEMENT

(71) Applicant: EMPIRE TECHNOLOGY DEVELOPMENT LLC, Wilmington, DE (US)

(72) Inventor: Mordehai Margalit, Zichron Yaaqov (IL)

(73) Assignee: EMPIRE TECHNOLOGY DEVELOPMENT LLC, Wilmington, DE (US)

( * ) Notice: Subject to any disclaimer, the term of this patent is extended or adjusted under 35 U.S.C. 154(b) by 0 days.

(21) Appl. No.: 15/117,165

(22) PCT Filed: Feb. 8, 2014

(86) PCT No.: PCT/US2014/015439

§ 371 (c)(1),
(2) Date: Aug. 5, 2016

(87) PCT Pub. No.: WO2015/119627

PCT Pub. Date: Aug. 13, 2015

(65) Prior Publication Data

US 2016/0360320 A1 Dec. 8, 2016

(51) Int. Cl.

| | |
|---|---|
| ***H04R 19/02*** | (2006.01) |
| ***H04R 7/04*** | (2006.01) |
| ***H04R 19/00*** | (2006.01) |

(52) U.S. Cl.

CPC ..... *H04R 19/02* (2013.01); *H04R 7/04* (2013.01); *H04R 19/005* (2013.01); *H04R 2201/003* (2013.01); *H04R 2217/03* (2013.01)

(58) Field of Classification Search
None
See application file for complete search history.

(56) References Cited

U.S. PATENT DOCUMENTS

| | | | |
|---|---|---|---|
| 3,939,467 | A | 2/1976 | Cook et al. |
| 5,889,870 | A | 3/1999 | Norris |

(Continued)

FOREIGN PATENT DOCUMENTS

| | | | |
|---|---|---|---|
| EP | 1737266 | A1 | 12/2006 |
| EP | 2271129 | A1 | 1/2011 |

(Continued)

OTHER PUBLICATIONS

Feiertag, Gregor, et al. "Determining the acoustic resistance of small sound holes for MEMS microphones." Procedia Engineering 25 (2011): 1509-1512.*

(Continued)

*Primary Examiner* — Curtis Kuntz
*Assistant Examiner* — Kenny Truong
(74) *Attorney, Agent, or Firm* — Turk IP Law, LLC

(57) ABSTRACT

Techniques described herein generally include methods and systems related to a MEMS-based audio speaker system configured for generating an audio signal. The speaker system includes one or more apertures in the speaker system positioned to receive the ultrasonic carrier signal and one or more movable and over-sized obstruction elements that are configured to modulate the ultrasonic carrier signal and thereby generate an audio signal. Because the movable obstruction elements are configured to overlap one or more edges of the apertures when in the closed position, modulation depth of the generated audio signal can be substantially improved or otherwise varied.

20 Claims, 7 Drawing Sheets

(56) References Cited

U.S. PATENT DOCUMENTS

| | | | | |
|---|---|---|---|---|
| 6,315,462 | B1 | 11/2001 | Anthamatten et al. | |
| 6,388,359 | B1 | 5/2002 | Duelli et al. | |
| 6,584,205 | B1 | 6/2003 | Croft, III et al. | |
| 6,606,389 | B1 | 8/2003 | Selfridge et al. | |
| 6,612,029 | B2 | 9/2003 | Behin et al. | |
| 6,678,381 | B1 | 1/2004 | Manabe | |
| 6,771,001 | B2 | 8/2004 | Mao et al. | |
| 6,778,672 | B2 | 8/2004 | Breed et al. | |
| 6,925,187 | B2 | 8/2005 | Norris et al. | |
| 7,502,486 | B2 | 3/2009 | Shin et al. | |
| 7,747,029 | B2 | 6/2010 | Kim et al. | |
| 7,881,489 | B2 | 2/2011 | Matsuzawa et al. | |
| 7,945,059 | B2 | 5/2011 | Miyazaki | |
| 7,961,900 | B2 | 6/2011 | Zurek et al. | |
| 8,079,246 | B2 | 12/2011 | Garmire et al. | |
| 8,428,278 | B2 | 4/2013 | Lastrucci | |
| 2006/0094988 | A1 | 5/2006 | Tosaya et al. | |
| 2006/0291667 | A1 | 12/2006 | Watanabe et al. | |
| 2008/0013761 | A1* | 1/2008 | Matsuzawa | B06B 1/0292 381/191 |
| 2008/0205195 | A1 | 8/2008 | Van Der Merwe | |
| 2008/0226096 | A1* | 9/2008 | Waddell | H04R 1/02 381/87 |
| 2008/0267431 | A1 | 10/2008 | Leidl et al. | |
| 2008/0285777 | A1 | 11/2008 | Pompei | |
| 2009/0152980 | A1 | 6/2009 | Huang | |
| 2010/0080409 | A1 | 4/2010 | Xu et al. | |
| 2010/0264777 | A1 | 10/2010 | Medhat et al. | |
| 2010/0289717 | A1 | 11/2010 | Arslan et al. | |
| 2011/0115337 | A1 | 5/2011 | Nakamura et al. | |
| 2011/0122731 | A1* | 5/2011 | Buccafusca | G10K 9/122 367/162 |
| 2011/0123043 | A1 | 5/2011 | Felberer et al. | |
| 2011/0182150 | A1 | 7/2011 | Cohen et al. | |
| 2012/0014525 | A1* | 1/2012 | Ko | H04S 7/302 381/17 |
| 2012/0017693 | A1 | 1/2012 | Robert et al. | |
| 2012/0177237 | A1* | 7/2012 | Shukla | B29C 45/1671 381/332 |
| 2012/0294450 | A1* | 11/2012 | Ozcan | H04R 3/007 381/59 |
| 2013/0044904 | A1 | 2/2013 | Margalit | |
| 2013/0121509 | A1 | 5/2013 | Hsu et al. | |
| 2013/0202119 | A1 | 8/2013 | Thiede | |

FOREIGN PATENT DOCUMENTS

| | | | |
|---|---|---|---|
| EP | 2381289 | A1 | 10/2011 |
| JP | S6262700 | A | 3/1987 |
| JP | 2004349815 | A | 12/2004 |
| JP | 2004363967 | A | 12/2004 |
| JP | 2005184365 | A | 7/2005 |
| JP | 2005354582 | A | 12/2005 |
| JP | 2007005872 | A | 1/2007 |
| JP | 2007124449 | A | 5/2007 |
| JP | 2007312019 | A | 11/2007 |
| JP | 2008048312 | A | 2/2008 |
| JP | 2008182583 | A | 8/2008 |
| JP | 2012216898 | | 11/2012 |
| KR | 1020050054648 | A | 6/2005 |
| WO | 9812589 | A1 | 3/1998 |
| WO | 173934 | A2 | 10/2001 |

OTHER PUBLICATIONS

"Capacitive Micromachined Ultrasonic Transducers (CMUTs)", Retrieved on Apr. 4, 2016 from the Internet at <URL: https://web.archive.org/web/20120126104159/http://www.me.gatech.edu/mist/cmut.htm>, pp. 4.

"Discover the Remarkable Novel Way to Transmit Sound", Retrieved on Mar. 28, 2016 from the Internet at <URL: https://web.archive.org/web/20120911234401/http://www.parametricsound.com/Technology.php>, pp. 4.

"Electrostatic Loudspeaker", Retrieved on Apr. 4, 2016 from the Internet at <URL:https://web.archive.org/web/20130828183848/http://en.wikipedia.org/wiki/Electrostatic_loudspeaker>, last modified on Feb. 27, 2013, pp. 6.

"First Major Innovation in Audio Speakers in Nearly 80 Years!", Audio Pixels Limited, Retrieved on Apr. 4, 2016 from the Internet at <URL:https://web.archive.org/web/20140125163627/http://www.audiopixels.com.au/index.cfm/technology/>, pp. 3.

"Hilbert Transform", Wikipedia, Retrieved on Mar. 28, 2016 from the Internet at <URL:https://web.archive.org/web/20131205110139/http://en.wikipedia.org/wiki/Hilbert_transform>, last modified on Dec. 4, 2013, pp. 17.

"ICsense Designs Asic for World's First Mems Speaker—Audio Pixels Limited and Icsense Enter Strategic Engagement to Support Production of Digital Mems Based Speaker Chip", Retrieved on Nov. 6, 2014 from the Internet at <URL:http://www.icsense.com/NEWS%3A%20Audiopixels>, posted on Oct. 9, 2013, pp. 2.

"Investor Video Presentation", Audio pixel Limited, Retrieved on Nov. 10, 2014 from the Internet at <URL:http://www.audiopixels.com.au/index.cfm/investor/video-presentation/>.

"Microelectromechanical Systems", Wikipedia, Retrieved on Apr. 4, 2016 from the Internet at <URL:https://web.archive.org/web/20131226230521/http://en.wikipedia.org/wiki/Microelectromechanical_systems>, last modified on Nov. 28, 2013, pp. 12.

"Single-sideband Modulation," Retrieved on Mar. 28, 2016 from the Internet at <URL:https://web.archive.org/web/20131217204859/http://en.wikipedia.org/wiki/Single-sideband_modulation>, last modified on Nov. 12, 2013, pp. 9.

"Sound from Ultrasound", Wikipedia, Retrieved on Mar. 28, 2016 from the Internet at <URL: https://web.archive.org/web/20130829134301/http://en.wikipedia.org/wiki/Sound_from_ultrasound>, last modified on Jun. 27, 2013, pp. 10.

Rick Daniell, "Digital Loudspeakers—Part 1", YouTube, Retrieved on Nov. 7, 2014 from the Internet at <URL: https://www.youtube.com/watch?v=VgeUUMvdPel>, Published on Apr. 29, 2012, pp. 2.

Brett M. Diamond, "Digital Sound Reconstruction Using Arrays of CMOS-MEMS Microspeakers", Electrical and Computer Engineering, 2002, pp. 1-60.

Extended European Search Report for European Patent Application No. 11870957.5 (PCT/US2011/04783), dated Apr. 14, 2015.

Extended European Search Report for European Patent Application No. 15200544.3, dated Feb. 19, 2016.

International Search Report and Written Opinion of the International Searching Authority, International application No. PCT/US2011/047833, dated Nov. 28, 2011.

International Search Report and Written Opinion of the International Searching Authority, International application No. PCT/US2014/015438, dated Nov. 7, 2014.

International Search Report and Written Opinion of the International Searching Authority, International application No. PCT/US2014/015439, dated Oct. 29, 2015.

International Search Report and Written Opinion of the International Searching Authority, International application No. PCT/US2014/015440, dated Oct. 27, 2015.

International Search Report and Written Opinion of the International Searching Authority, International application No. PCT/US2014/015441, dated Oct. 29, 2015.

Eino Jakku et al., "The Theory of Electrostatic Forces in a Thin Electret (MEMS) Speaker", Proceedings IMAPS Nordic 2008 Helsingor, Sep. 14-16, 2008, pp. 95-100.

Brian D. Jensen et al., "Shaped Comb Fingers for Tailored Electromechanical Restoring Force", Journal of Microelectromechanical Systems, Jun. 25, 2003, pp. 373-383, vol. 12, No. 3.

Anatol Khilo et al., "Broadband Linearized Silicon Modulator", Optics Express, Feb. 23, 2011, pp. 4485-4500, vol. 19, No. 5.

Rob Legtenberg et al., "Comb-Drive Actuators for Large Displacements", Journal of Micromechanics and Microengineering, 1996, pp. 320-329, vol. 6.

(56) References Cited

OTHER PUBLICATIONS

Isaac Leung, "Sony to Help Develop Next-generation MEMS-based Speakers", Retrieved on Apr. 4, 2016 from the Internet at <URL: https://web.archive.org/web/20120327134931/http://www.electronicsnews.com.au/features/sony-to-help-develop-next-generation-mems-based-sp>, posted on Jul. 8, 2011, pp. 2.
Nguyen, C., "MEMS Comb-Drive Actuators", Microfabrication Technology, 2010, pp. 3.
M. Olfatnia et al., "Note: An Asymmetric Flexure Mechanism for Comb-Drive Actuators", Review of Scientific Instruments, 2012, pp. 116105-1-116105-3, vol. 83, Issue 11.
Mohammad Olfatnia et al., "Large Stroke Electrostatic Comb-Drive Actuators Enabled by a Novel Flexure Mechanism", Journal of Microelectromechanical Systems, Apr. 2013, pp. 483-494, vol. 22, No. 2.
Alexander A Trusov et al., "Capacitive Detection in Resonant MEMS with Arbitrary Amplitude of Motion", Journal of Micromechanics and Microengineering, Aug. 2007, pp. 1583-1592, vol. 17.
Tristan T. Trutna et al., "An Enhanced Stability Model for Electrostatic Comb-Drive Actuator Design", Proceedings of the ASME 2010 International Design Engineering Technical Conferences & Computers and Information in Engineering Conference IDETC/CIE, Aug. 15-18, 2010.
Wenjing Ye et al., "Optimal Shape Design of an Electrostatic Comb Drive in Microelectromechanical Systems", Journal of Microelectromechanical Systems, Mar. 1998, pp. 16-26, vol. 7, No. 1.
Masahide Yoneyama et al., "The Audio Spotlight: An Application of Nonlinear Interaction of Sound Waves to a New Type of Loudspeaker Design", Journal of the Acoustical Society of America, May 1983, pp. 1532-1536, vol. 73, No. 5.

* cited by examiner

MEMS-BASED AUDIO SPEAKER SYSTEM WITH MODULATION ELEMENT

CROSS-REFERENCE TO RELATED APPLICATION

The present application is a U.S. National Stage filing under U.S.C. § 371 of International Application No. PCT/52014/015439, filed on Feb. 8, 2014 and entitled "MEMS-BASED AUDIO SPEAKER SYSTEM WITH MODULATION ELEMENT."The international Application, including any appendices or attachments thereof, is hereby incorporated by reference in its entirety.

BACKGROUND

Unless otherwise indicated herein, the approaches described in this section are not prior art to the claims in this application and are not admitted to be prior art by inclusion in this section.

Loudspeaker design has changed little in nearly a century. A loudspeaker (or "speaker") is an electro-acoustic transducer that produces sound in response to an electrical signal input. The electrical signal causes a vibration of the speaker cone in relation to the electrical signal amplitude. The resulting pressure change is the sound heard by the ear. In traditional speakers, the sound level is related to the square of the frequency. Consequently, speakers for producing low-frequency sounds may be larger and more powerful than speakers for producing higher-frequency sounds. It is for this reason that small tweeters may be commonly used for high-frequency audio signals and large subwoofers may be used for generating low-frequency audio signals.

SUMMARY

In accordance with at least some embodiments of the present disclosure, a speaker device may comprise a planar oscillation element, a shutter element, and an aperture. The planar oscillation element may be configured to generate an ultrasonic acoustic signal in a direction orthogonal to a surface of the planar oscillation element. The aperture may be positioned to receive the ultrasonic acoustic signal and the shutter element may be configured to obscure the aperture to modulate the ultrasonic acoustic signal such that an audio signal is generated, wherein a portion of the shutter element that is configured to obscure the aperture is larger than the aperture.

In accordance with at least some embodiments of the present disclosure, a method of generating an audio signal comprises generating an ultrasonic acoustic signal with a planar oscillation element, directing the ultrasonic acoustic signal through an aperture positioned to receive the ultrasonic acoustic signal, and modulating the ultrasonic acoustic signal to generate an audio signal by alternately obscuring and revealing the aperture using a shutter element. The shutter element includes a portion configured to obscure the aperture that is larger than the aperture.

The foregoing summary is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF THE DRAWINGS

The foregoing and other features of the present disclosure will become more fully apparent from the following description and appended claims, taken in conjunction with the accompanying drawings. These drawings depict only several embodiments in accordance with the disclosure and are, therefore, not to be considered limiting of its scope. The disclosure will be described with additional specificity and detail through use of the accompanying drawings.

DETAILED DESCRIPTION

Figure 1:
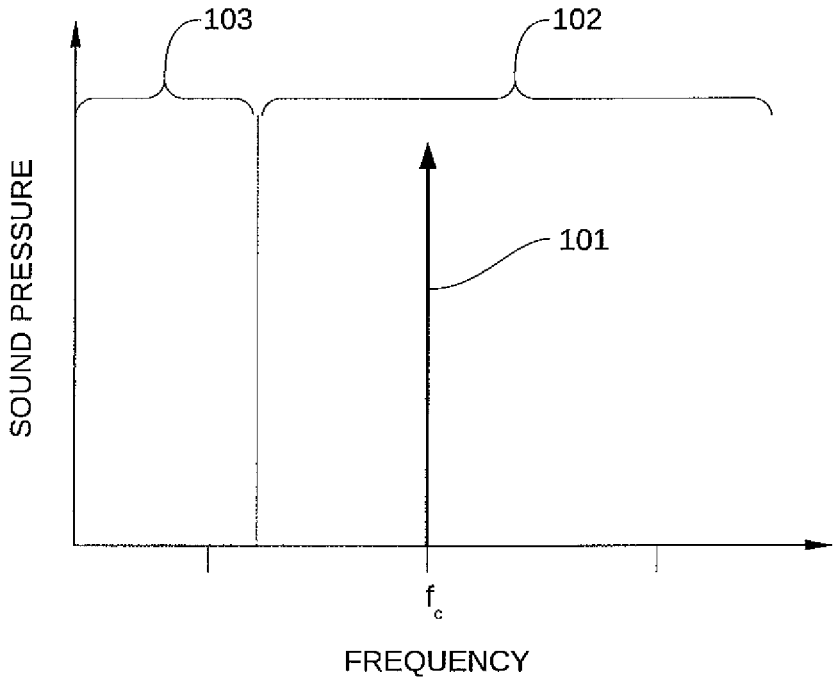
FIG. 1 schematically illustrates an example ultrasonic signal generated by a MEMS-based audio speaker system.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here. The aspects of the disclosure, as generally described herein, and illustrated in the Figures, can be arranged, substituted, combined, and designed in a wide variety of different configurations, all of which are explicitly contemplated and made part of this disclosure.

Microelectromechanical systems, or MEMS, is a technology that includes miniaturized mechanical and electromechanical elements, devices, and structures that may be produced using batch micro-fabrication or micro-machining techniques associated with the integrated circuit industry. The various physical dimensions of MEMS devices can vary greatly, for example from well below one micron to as large as the millimeter scale. In addition, there may be a wide range of different types of MEMS devices, from relatively simple structures having no moving elements, to extremely complex electromechanical systems with multiple moving elements under the control of integrated microelectronics. Such devices may include microsensors, microactuators, and microelectronics. Microsensors and microactuators may be categorized as "transducers," which are devices that may convert energy from one form to another. In the case of microactuators, a MEMS device may typically convert an electrical signal into some form of mechanical actuation.

MEMS microactuators may be used for a wide variety of miniaturized mechanical and electro-mechanical devices. However, the small size of MEMS devices has mostly precluded the use of MEMS technology for audio speaker applications, since the frequency of sound emitted by a micron-scale oscillating membrane is generally in the ultrasonic regime. Some MEMS acoustic modulators may be used to create audio signals from a high frequency acoustic source, such as a MEMS-based audio speaker system. Specifically, a particular audible audio signal may be created by generating an ultrasonic signal with a MEMS oscillation membrane or a piezoelectric transducer, and then modulating the ultrasonic signal with an acoustic modulator, such as a MEMS shutter element. Because the ultrasonic signal may act as an acoustic carrier wave and the acoustic modulator may superimpose an input signal thereon by modulating the ultrasonic signal, the resultant signal generated by the MEMS-based audio speaker system may be a function of the frequency difference between the ultrasonic signal and the input signal. In this way, acoustic signals can be generated by a MEMS-based audio speaker system in the audible range and as low as the sub-100 Hz range despite the very small size of such a speaker system.

FIG. 1 schematically illustrates an example ultrasonic signal 101 generated by the above-described MEMS-based audio speaker system. As shown, ultrasonic signal 101 may be located at the carrier frequency $f_C$ in the ultrasound region 102 of the sound frequency spectrum, and not in the audible region 103 of the sound frequency spectrum. The audible region 103 may generally include the range of human hearing, extending from about 20 Hz to about 20 kHz, and the ultrasound region 102 may include some or all frequencies higher than about 20 kHz.

Figure 2:
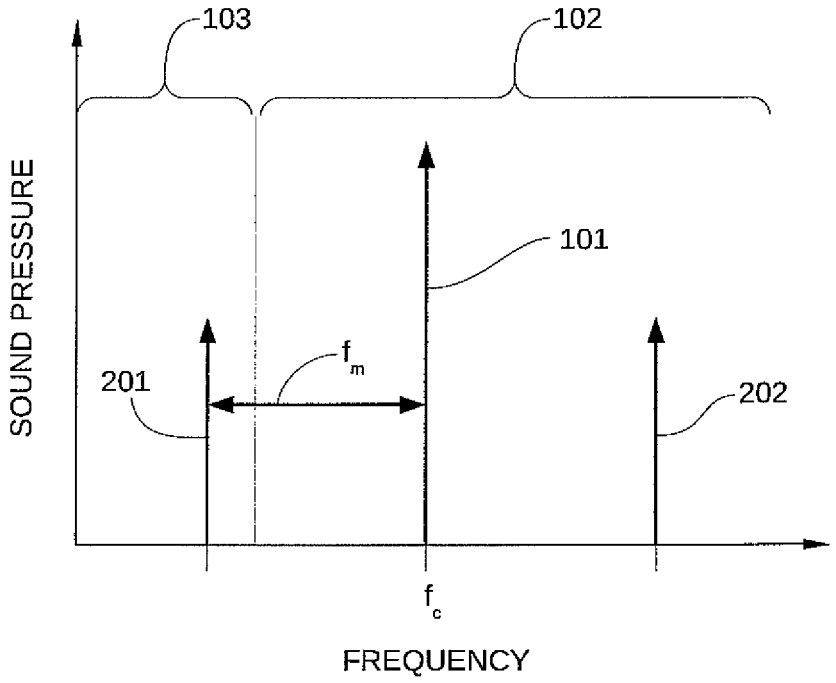
FIG. 2 schematically illustrates examples of a low frequency modulated sideband and a high frequency modulated sideband, which may be generated when the ultrasonic signal of FIG. 1 is amplitude modulated with an acoustic modulator in the MEMS-based audio speaker system.

FIG. 2 schematically illustrates examples of a low frequency modulated sideband 201 and high frequency modulated sideband 202, which may be generated when ultrasonic signal 101 is amplitude modulated with an acoustic modulator in the above-described MEMS-based audio speaker system. Low frequency modulated sideband 201 and high frequency modulated sideband 202 may be harmonic signals that are each functions of the modulation frequency $f_m$, where the modulation frequency $f_m$ may be, for example, the frequency of modulation of the MEMS shutter element or other acoustic modulator of the MEMS-based audio speaker system. Specifically, low frequency modulated sideband 201 and high frequency modulated sideband 202 may each be functions of the frequency difference between the carrier frequency $f_C$ and the modulation frequency $f_m$. High frequency modulated sideband 202 may be located in ultrasound region 102 and therefore may not be audible. In contrast, low frequency modulated sideband 201 may be located in audible region 103, and may represent an audible output signal from the MEMS-based audio speaker system. Thus, an audible signal can be generated by a MEMS-based audio speaker system.

In light of the issues described above with some MEMS-based audio speaker systems, this disclosure is generally drawn, inter alia, to methods, apparatus, systems, and devices, related to MEMS devices.

Briefly stated, a MEMS-based audio speaker system according to embodiments of the present disclosure, may include one or more planar oscillation elements configured to generate an ultrasonic acoustic signal and one or more movable and over-sized obstruction elements, referred to herein as shutter elements. Each of the one or more shutter elements may include a portion configured to obscure an opening that is positioned to receive the ultrasonic acoustic signal generated by the one or more planar oscillation elements. By alternately obscuring and revealing the opening at modulation frequency $f_m$, the ultrasonic acoustic signal can be modulated so that an audio signal is generated, such as low frequency modulated sideband 201 in FIG. 2. Stated another way, a shutter element can be used to implement a modulation function on an acoustic carrier signal (that is for example at carrier frequency $f_c$) to generate an audio signal. Thus, given an appropriate modulation function and a suitably configured shutter element, a target acoustic output signal for the MEMS-based audio speaker system can be generated. An embodiment of one such MEMS-based audio speaker system is illustrated in FIG. 3.

Figure 3:
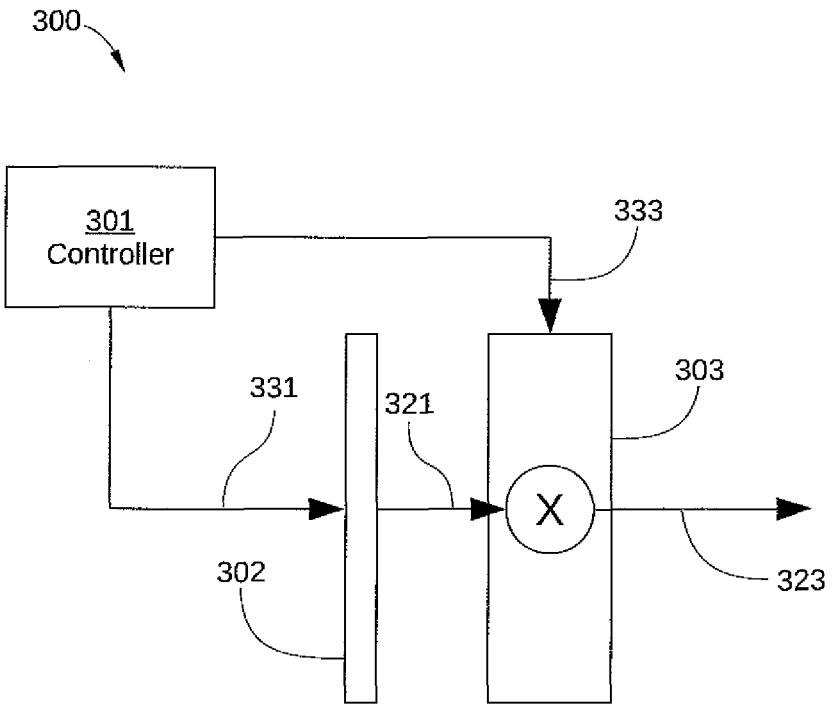
FIG. 3 is a block diagram illustrating a MEMS-based audio speaker system, also referred to as a pico speaker system.

FIG. 3 is a block diagram illustrating a MEMS-based audio speaker system, also referred to as a pico speaker system 300, arranged in accordance with at least some embodiments of the present disclosure. Pico speaker system 300 may be a compact, energy-efficient acoustic generator capable of producing acoustic signals throughout the audible portion of the sound frequency spectrum, for example from the sub-100 Hz range to 20 kHz and above. As such, pico speaker system 300 may be well-suited for mobile devices and/or any other applications in which size, sound fidelity, or energy efficiency are beneficial.

Pico speaker system 300 may include a controller 301, an oscillation membrane 302, and a MEMS shutter 303, arranged to be operatively coupled to each other such as shown in FIG. 3. In some embodiments, oscillation membrane 302, and MEMS shutter 303 may be configured as part of a single MEMS structure, where oscillation membrane 302 may be formed from a layer or thin film on a substrate and MEMS shutter 303 may be formed from a different layer or thin film on the substrate. In other embodiments, MEMS shutter 303 may be formed from a layer or thin film on a MEMS substrate and oscillation membrane 302 may be a separately fabricated device that is coupled to the MEMS substrate, such as a piezoelectric transducer. Other configurations of MEMS shutters and oscillation membranes arranged in a pico speaker system may also fall within the scope of the present disclosure.

Controller 301 may be configured to control the various active elements of pico speaker system 300 so that a resultant acoustic signal 323 is produced by pico speaker system 300 that is substantially similar to a target audio output. For example, controller 301 may be configured to generate and supply oscillation signal 331 to oscillation membrane 302 so that oscillation membrane 302 generates an ultrasonic acoustic carrier signal 321. Controller 301 may also be configured to generate and supply a modulation signal 333 to MEMS shutter 303. Oscillation signal 333 is described in greater detail below. Controller 301 may include logic circuitry incorporated in pico speaker system 300 and/or a logic chip or other circuitry that is located remotely from pico speaker system 300. Alternatively or additionally, some or all functions or operations of controller 301 may be performed by a software construct or module that is loaded into such circuitry or is executed by one or more processor devices associated with pico speaker system 300. In some embodiments, the logic circuitry of controller 301 may be fabricated in the MEMS substrate from which MEMS shutter 303 is formed.

Oscillation membrane 302 may be any technically feasible device configured to generate ultrasonic acoustic carrier signal 321, where ultrasonic acoustic carrier signal 321 may be an ultrasonic acoustic signal of a fixed frequency. In some embodiments, ultrasonic acoustic carrier signal 321 may have a fixed frequency of at least about 50 kHz, for example. In some embodiments, ultrasonic acoustic carrier signal 321 may have a fixed frequency that is significantly higher than 50 kHz, for example 100 kHz or more. Furthermore, in some embodiments, oscillation membrane 302 may have a very small form factor, for example on the order of 10s or 100s of microns. Consequently, in some embodiments, oscillation membrane 302 may be a MEMS oscillation membrane or other planar oscillation element formed from a layer or thin film disposed on a MEMS substrate and micro-machined accordingly. Thus, oscillation membrane 302 may be substantially stationary with respect to adjacent elements of pico speaker system 300, e.g., having one, some, or all edges anchored to adjacent elements of pico speaker system 300.

In such embodiments, a target oscillation may be induced in oscillation membrane 302 via any suitable electrostatic MEMS actuation scheme, in which a time-varying voltage signal (e.g., oscillation signal 331) is applied to oscillation membrane 302. Alternatively, oscillation membrane 302 may be a piezoelectric transducer configured to generate ultrasonic acoustic carrier signal 321. In either case, oscillation membrane 302 may be oriented so that ultrasonic acoustic carrier signal 321 can be directed toward MEMS shutter 303, as shown in FIG. 3. In the embodiment illustrated in FIG. 3, ultrasonic acoustic carrier signal 321 may be generated in a direction substantially orthogonal to a primary surface 302A (see FIG. 4) of oscillation membrane 302.

MEMS shutter 303 may be a micro-machined shutter element that is configured to modulate ultrasonic acoustic carrier signal 321 according to modulation signal 333 to generate audio signal 323. Thus, as indicated in FIG. 3, MEMS shutter 303 multiplies ultrasonic acoustic carrier signal 321, which may be a sinusoidal function, by modulation signal 333, which may also be a sinusoidal function. The result of such a multiplication may be a sum of frequencies and a difference of frequencies, where the sum of frequencies may correspond to twice the modulation signal (for example high frequency modulated sideband 202 in FIG. 2) and the difference of frequencies may correspond to the audible audio signal (for example low frequency modulated sideband 201 in FIG. 2). Thus, when modulation signal 333 is based on a suitable modulation function, audio signal 323 may be produced that is substantially similar to a target audio output for pico speaker system 300.

The modulation function, referred to herein as A(t), used to generate modulation signal 333, may be based on a target audio signal to be generated by pico speaker system 300. For example, in some embodiments, modulation function A(t) may include a time-varying acoustic signal that substantially corresponds to the target audio output of the pico speaker system 300. In some embodiments, modulation function A(t) may also include additional elements that enhance fidelity of audio signal 323 with respect to the target audio output. For example, modulation function A(t) may include one or more predistortion elements configured to compensate for frequency-dependent behavior associated with the pico speaker system. Alternatively or additionally, modulation function A(t) may include one or more elements to augment one or more bands of the output of pico speaker system 300, such as bass or treble. In some embodiments, modulation function A(t) may be provided to controller 301 during operation and controller 301 may then generate a suitable modulation signal 333. Alternatively, a target acoustic output for pico speaker system 300 may be provided to controller 301, and controller 301 may determine both modulation function A(t) and modulation signal 333.

In some embodiments, modulation signal 333 may be a time-varying voltage signal configured to cause MEMS shutter 303 to be displaced in a manner described by first modulation function A(t). In terms of a single tone, $A(t)=\sin(\Omega_1 t)$, where $\Omega_1$ is the frequency of the single tone. Thus, an acoustic signal S(t) generated by pico speaker system 300 can be generally described by the relation $S(t)=\cos(\Omega t)A(t)$, where $\Omega$ is the carrier frequency.

Figure 4:
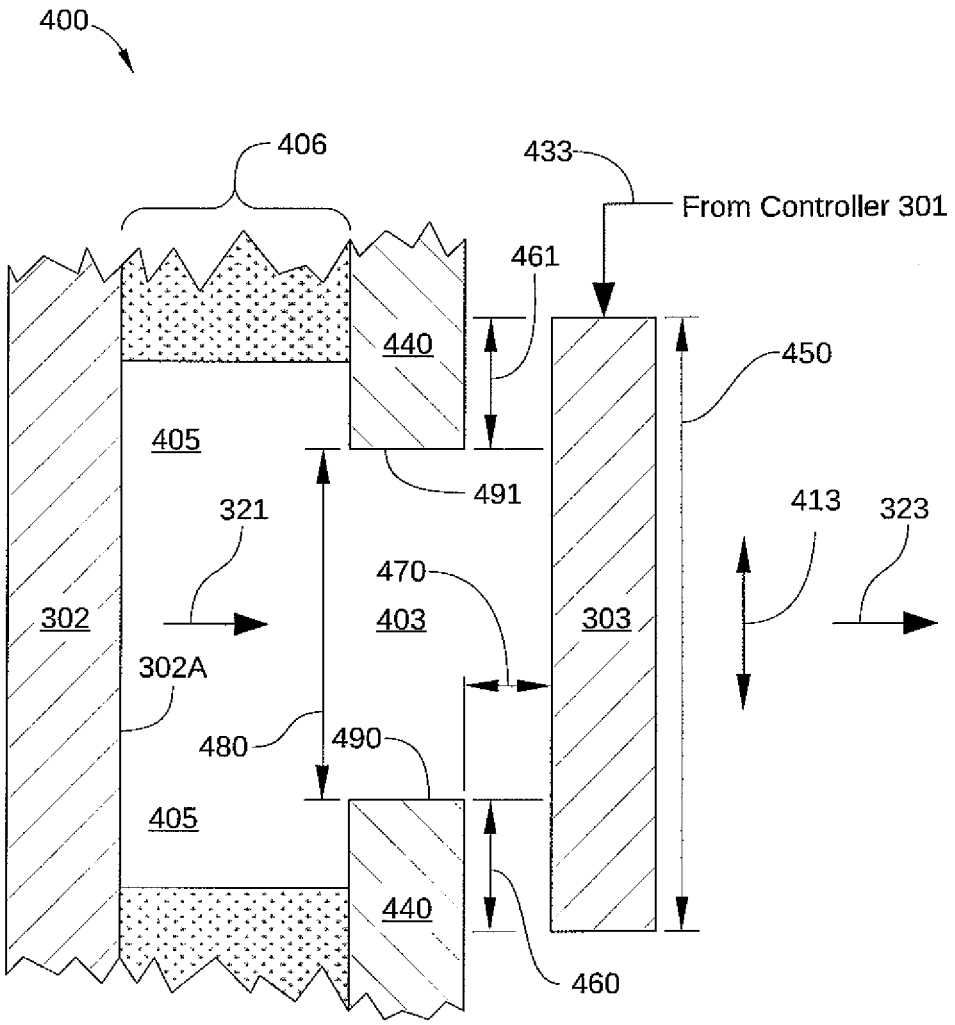
FIG. 4 is a cross-sectional view of an example embodiment of a pico speaker system in which a MEMS shutter is configured to perform amplitude modulation of an ultrasonic carrier signal.

FIG. 4 is a cross-sectional view of an example embodiment of a pica speaker system 400 in which MEMS shutter 303 is configured to perform amplitude modulation of ultrasonic carrier signal 321 in accordance with at least some embodiments of the present disclosure. In the embodiment illustrated in FIG. 4, pico speaker system 400 may be realized as a MEMS structure formed from various layers and/or thin films formed on a MEMS substrate. Pico speaker system 400 may include oscillation membrane 302, an acoustic pipe 405, an aperture 403, and MEMS shutter 303.

As noted previously, oscillation membrane 302 may be formed from a layer or thin film on a substrate and MEMS shutter 303 may be formed from a different layer or thin film on the substrate. Acoustic pipe 405 may be formed by the removal of a portion of a sacrificial layer 406 that is formed on the MEMS substrate. Aperture 403 may have a width 480 on the order of 10s or 100s of microns and, in some embodiments, may be formed in a blind element 440 that is disposed between oscillation membrane 302 on one side and MEMS shutter 303 on the other side. In such embodiments, blind element 440 may be formed from a layer or thin film disposed on the MEMS substrate on which oscillation membrane 302 and MEMS shutter 303 are formed. Furthermore, in some embodiments, aperture 403 may be configured as a plurality of openings formed in blind element 440 that can be obscured by MEMS shutter 303 rather than as a single opening in blind element 440 as shown in FIG. 4.

In some embodiments, MEMS shutter 303 may be configured to translate in a direction substantially orthogonal to the direction in which ultrasonic carrier signal 321 propagates. For example in FIG. 4, if ultrasonic carrier signal 321 is propagating from left to right along an x-axis, MEMS shutter 303 may translate up or down along a y-axis. In such embodiments, MEMS shutter 303 may be positioned substantially parallel to primary surface 302A of oscillation membrane 302. In addition, in such embodiments, a MEMS comb drive (not shown) may be used to convert a voltage signal 433 from controller 301 into a displacement 413 of MEMS shutter 303. Any suitable configuration of a MEMS comb drive may be used for actuating MEMS shutter 303 in FIG. 4.

Any other type of technically feasible MEMS actuator may also be used to convert voltage signal 433 into displacement 413 of MEMS shutter 303. For example, any MEMS actuators may be used that 1) can provide sufficient magnitude of displacement 413 to obscure and reveal aperture 403, and 2) has an operational bandwidth that includes the frequency of ultrasonic carrier signal 321. Furthermore, the dimensions of MEMS shutter 303 and magnitude of displacement 413 may be selected such that aperture 403 can be completely covered by MEMS shutter 303 and edges 490 and 491 can be overlapped respectively by overlap distances 460 and 461, as described below.

As shown, in some embodiments, ultrasonic carrier signal 321 may be generated by oscillation membrane 302 and propagate into acoustic pipe 405. Ultrasonic carrier signal 321 may pass from acoustic pipe 405 through aperture 403, which is alternately obscured and revealed by MEMS shutter 303, where the motion of MEMS shutter 303 along displacement 413 may be defined by modulation signal 333. Modulation signal 333 (shown in FIG. 3) may be implemented as displacement 413 of MEMS shutter 303 via the appropriate voltage signal 433 applied to MEMS shutter 303 by controller 301. Movement of MEMS shutter 303 in this manner in response to voltage signal 433 modulates ultrasonic carrier signal 321 to generate audio signal 323.

According to embodiments of the present disclosure, modulation depth of audio signal 323 can be substantially improved by obscuring aperture 403 with a shutter element that is significantly larger than aperture 403. Thus, in some embodiments, a portion of MEMS shutter 303 that is configured to obscure aperture 403 may also be over-sized so as to be larger than aperture 403. For example, in FIG. 4, MEMS shutter 303 may have a length 450 that is greater than width 480 of aperture 403. Thus, when MEMS shutter 303 is positioned to obscure aperture 403 (herein referred to herein as the "closed" position), MEMS shutter 303 may overlap the edge 490 of aperture 403 by an overlap distance 460. In some embodiments, length 450 may be selected so that when MEMS shutter 303 is positioned to obscure aperture 403, MEMS shutter 303 also overlaps the edge 491 of aperture 403 and/or all other edges (not shown) of aperture 403 by at least overlap distance 461. Because MEMS shutter 303 is configured to be larger than aperture 403, the modulation depth of ultrasonic acoustic signal 321 can be increased, e.g., the modulation ratio between MEMS shutter 303 in the open and closed positions may be increased. As described below, overlap distances 460 and 461 may be selected to optimize or otherwise vary the modulation depth of audio signal 323.

Various possible configurations of pico speaker system 400 in FIG. 4 can be provided to illustrate example effects of changing various physical parameters of speaker system 400 on sound pressure level (SPL) at the output of the speaker system 400. Parameters that can be changed may include overlap distance 460, length 450 of MEMS shutter 303, size of a gap 470 between MEMS shutter 303 and blind element 440, width 480 of aperture 403, and frequency of ultrasonic carrier signal 321. Gap 470 may be generally present between MEMS 303 and blind element 440 due to the micro-fabrication process used to form pico speaker system 400 from layers formed on a MEMS substrate, and can be on the order of a few microns or more in size.

Figure 5:
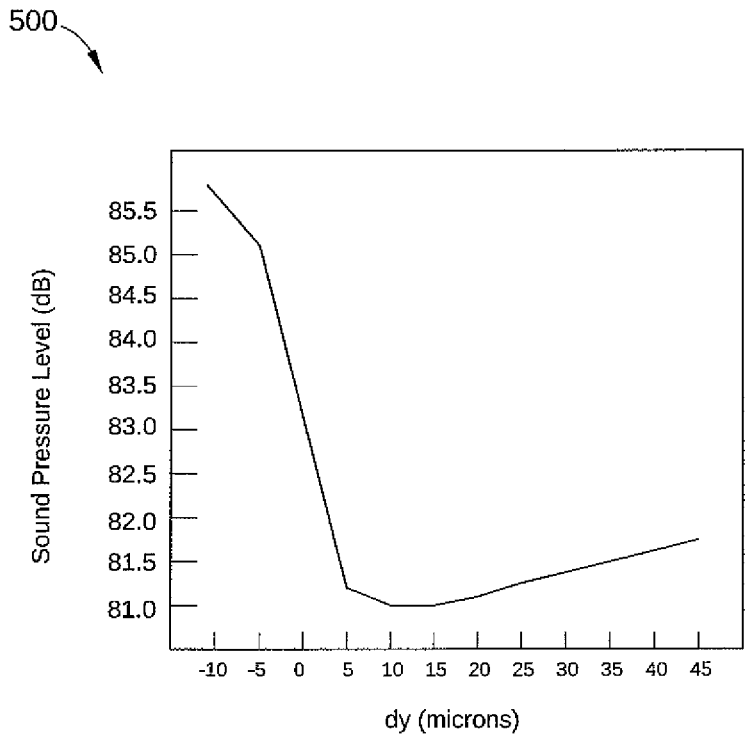
FIG. 5 is a graph showing an example of sound pressure level vs. magnitude of an overlap distance in a pico speaker system.

According to some embodiments, configuring MEMS shutter 303 so that overlap distance 460 is equal to or greater than the size of gap 470 can greatly enhance modulation depth of audio signal 323. Some of these features are illustrated in FIG. 5. FIG. 5 is a graph 500 showing an example of SPL vs. magnitude of overlap distance 460 in a pico speaker system arranged according to an embodiment of the present disclosure. The abscissa of graph 500 indicates the magnitude of overlap distance 460 in microns, where 0 microns indicates that an edge of MEMS shutter 303 is aligned with edge 490 of aperture 403, and where positive values indicate that MEMS shutter 303 overlaps edge 490. For the results shown in FIG. 5, gap 470 is 2 microns, width 480 of aperture 403 is 50 microns, and ultrasonic carrier signal 321 has a frequency of 100 kHz. As shown, SPL decreases as MEMS shutter 303 is moved from a slightly open position (dy=−10 microns) to a fully closed and overlapping position (dy≥0 microns). Similar results were obtained for smaller width 480 and for an ultrasonic carrier signal 321 frequency of 150 kHz. Thus, moving MEMS shutter 303 to a closed position that is greater than gap 470 (i.e., greater than two microns), may significantly reduce SPL. In embodiments in which MEMS shutter 303 is moved to a closed position that is greater than or equal to twice the size of gap 470 (i.e., four or more microns), further improvement in the modulation depth of audio signal 323 is indicated.

Generally, there may be a trade-off between overlap distance 460 and a maximum frequency at which MEMS shutter 303 can be cycled between fully obscuring and fully revealing aperture 403. This is because larger overlap distance 460 requires a larger displacement 413 of MEMS shutter 303, which reduces the maximum frequency at which MEMS shutter 303 can oscillate. Consequently, in some embodiments, MEMS 303 may be configured to have an overlap distance 460 of no more than about twice the size of gap 470.

Figure 6:
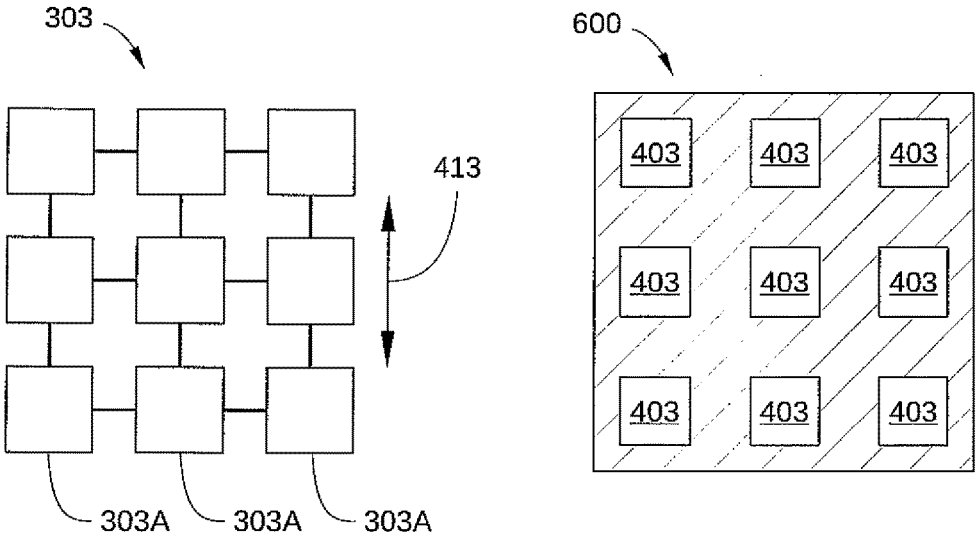
FIG. 6 is a schematic diagram illustrating one configuration of a MEMS shutter and a corresponding array of apertures.

FIG. 6 is a schematic diagram illustrating one configuration of MEMS shutter 303 and a corresponding array 600 of apertures 403, arranged in accordance with at least some embodiments of the present disclosure. For clarity, a MEMS actuator coupled to MEMS shutter 303 is omitted from FIG. 6. As shown, array 600 may include a plurality of apertures 403, and MEMS shutter 303 may include a plurality of portions 303A that may each be configured to obscure a respective one of the plurality of apertures 403, where each of portions 303A is larger than the corresponding aperture 403 that the portion is configured to obscure. For reference, displacement 413 is indicated in FIG. 6. For purposes of illustration, MEMS shutter 303 and array 600 are depicted side-by-side, while in practice portions 303A of MEMS shutter 303 are substantially aligned with (e.g., on top of in this view) the plurality of apertures 403.

Figure 7:
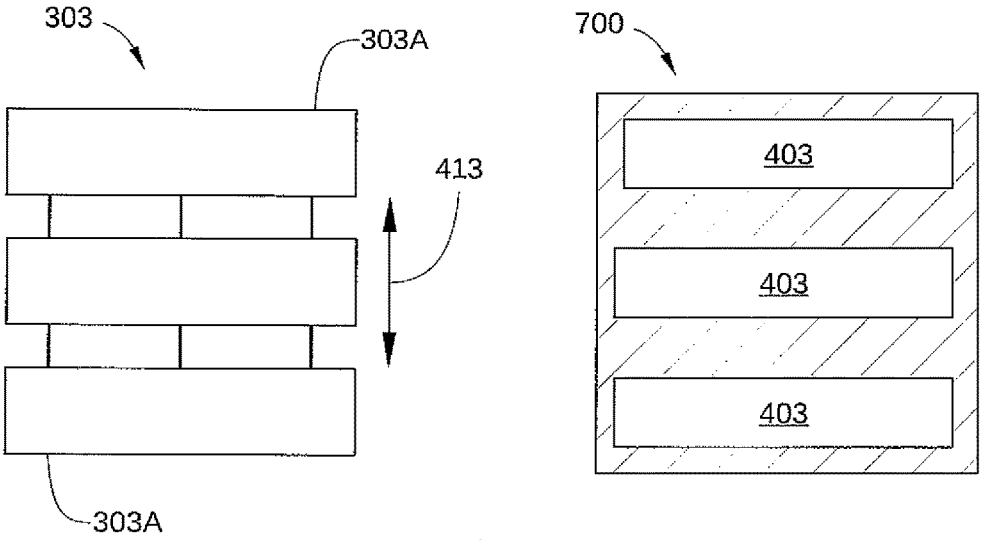
FIG. 7 is a schematic diagram illustrating another configuration of a MEMS shutter and a corresponding array of apertures.

FIG. 7 is a schematic diagram illustrating another configuration of MEMS shutter 303 and a corresponding array 700 of apertures 403, arranged in accordance with at least some embodiments of the present disclosure. For clarity, a MEMS actuator coupled to MEMS shutter 303 is omitted from FIG. 7. As shown, array 700 may include a plurality of apertures 403, and MEMS shutter 303 may include a plurality of portions 303A that may each be configured to at least partially obscure a respective one of the plurality of apertures 403, where each of portions 303A is larger than the aperture 403 that the portion is configured to obscure. For reference, displacement 413 is also indicated in FIG. 7. For purposes of illustration, MEMS shutter 303 and array 700 are depicted side-by-side, while in practice portions 303A of MEMS shutter 303 are substantially aligned with (e.g., on top of in this view) the plurality of apertures 403.

It is noted that FIGS. 6 and 7 provide just two example configurations of the disclosure. Other configurations are also possible that provide a different number, shape, size, and/or arrangement of the apertures 403 and portions 303A.

Figure 8:
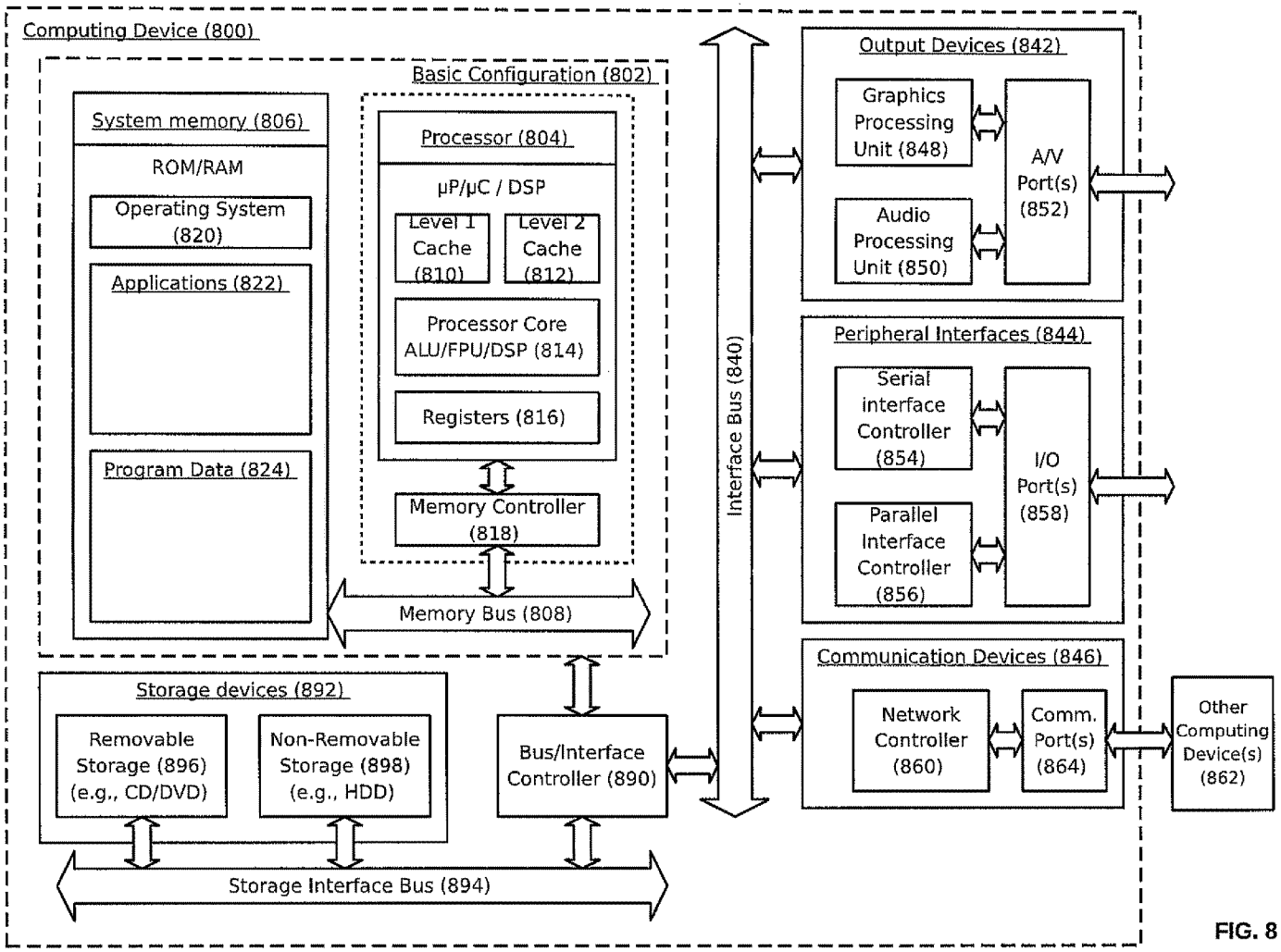
FIG. 8 is a block diagram illustrating an example computing device 800 in which one or more embodiments of the present disclosure may be implemented, all arranged in accordance with at least some embodiments of the present disclosure.

FIG. 8 is a block diagram illustrating an example computing device 800 that is arranged to to implement at least some embodiments of the present disclosure. In a very basic configuration 802, computing device 800 typically includes one or more processors 804 and a system memory 806. A memory bus 808 may be used for communicating between processor 804 and system memory 806.

Depending on the desired configuration, processor 804 may be of any type including but not limited to a microprocessor (μP), a microcontroller (μC), a digital signal processor (DSP), or any combination thereof. Processor 804 may include one more levels of caching, such as a level one cache 810 and a level two cache 812, a processor core 814, and registers 816. An example processor core 814 may include an arithmetic logic unit (ALU), a floating point unit (FRU), a digital signal processing core (DSP Core), or any combination thereof. Processor 804 may include programmable logic circuits, such as, without limitation, field-programmable gate arrays (FPGAs), patchable application-specific integrated circuits (ASICs), complex programmable logic devices (CPLDs), and others. An example memory controller 818 may also be used with processor 804, or in some implementations memory controller 818 may be an internal part of processor 804.

Depending on the desired configuration, system memory 806 may be of any type including but not limited to volatile memory (such as RAM), non-volatile memory (such as ROM, flash memory, etc.) or any combination thereof. System memory 806 may include an operating system 820, one or more applications 822, and program data 824. Program data 824 may include data that may be useful for operation of computing device 800. In some embodiments, application 822 may be arranged to operate with program data 824 on operating system 820. This described basic configuration 802 is illustrated in FIG. 8 by those components within the inner dashed line. In such embodiments, application 822 may be used to generate A(t) discussed above, generate one or more of oscillation signal 331, oscillation signal 333, and voltage signal 433, and/or otherwise control the operation of controller 301 or control operation of other components of pico speaker system 300.

Computing device 800 may have additional features or functionality, and additional interfaces to facilitate communications between basic configuration 802 and any required devices and interfaces. For example, a bus/interface controller 890 may be used to facilitate communications between basic configuration 802 and one or more data storage devices 892 via a storage interface bus 894. Data storage devices 892 may be removable storage devices 896, non-removable storage devices 898, or a combination thereof. Examples of removable storage and non-removable storage devices include magnetic disk devices such as flexible disk drives and hard-disk drives (HDDs), optical disk drives such as compact disk (CD) drives or digital versatile disk (DVD) drives, solid state drives (SSDs), and tape drives to name a few. Example computer storage media may include volatile and nonvolatile, removable and non-removable media implemented in any method or technology for storage of information, such as computer readable instructions, data structures, program modules, or other data.

System memory 806, removable storage devices 896 and non-removable storage devices 898 are examples of computer storage media. Computer storage media includes, but is not limited to, RAM, ROM, EEPROM, flash memory or other memory technology, CD-ROM, digital versatile disks (DVDs) or other optical storage, magnetic cassettes, magnetic tape, magnetic disk storage or other magnetic storage devices, or any other medium which may be used to store the desired information and which may be accessed by computing device 800. Any such computer storage media may be part of computing device 800.

Computing device 800 may also include an interface bus 840 for facilitating communication from various interface devices (e.g., output devices 842, peripheral interfaces 844, and communication devices 846) to basic configuration 802 via bus/interface controller 890. Example output devices 842 include a graphics processing unit 848 and an audio processing unit 850, which may be configured to communicate to various external devices such as a display or speakers via one or more A/V ports 852. Such speakers may include one or more embodiments of pico speaker systems as described herein. Example peripheral interfaces 844 include a serial interface controller 854 or a parallel interface controller 856, which may be configured to communicate with external devices such as input devices (e.g., keyboard, mouse, pen, voice input device, touch input device, etc.) or other peripheral devices (e.g., printer, scanner, etc.) via one or more I/O ports 858. An example communication device 846 includes a network controller 860, which may be arranged to facilitate communications with one or more other computing devices 862 over a network communication link, such as, without limitation, optical fiber, Long Term Evolution (LTE), 3G, WiMax, via one or more communication ports 864.

The network communication link may be one example of a communication media. Communication media may typically be embodied by computer readable instructions, data structures, program modules, or other data in a modulated data signal, such as a carrier wave or other transport mechanism, and may include any information delivery media. A "modulated data signal" may be a signal that has one or more of its characteristics set or changed in such a manner as to encode information in the signal. By way of example, and not limitation, communication media may include wired media such as a wired network or direct-wired connection, and wireless media such as acoustic, radio frequency (RE), microwave, infrared (IR) and other wireless media. The term computer readable media as used herein may include both storage media and communication media.

Computing device 800 may be implemented as a portion of a small-form factor portable (or mobile) electronic device such as a cell phone, a personal data assistant (PDA), a personal media player device, a wireless web-watch device, a personal headset device, an application specific device, or a hybrid device that include any of the above functions. Computing device 800 may also be implemented as a personal computer including both laptop computer and non-laptop computer configurations.

As described herein, embodiments of the present disclosure include a MEMS-based audio speaker system configured to generate an audio signal. The speaker system may include one or more apertures in the speaker system positioned to receive the ultrasonic carrier signal and one or more movable and over-sized obstruction elements that are configured to modulate the ultrasonic carrier signal and thereby generate an audio signal. Because the movable obstructing elements are configured to overlap one or more edges of the apertures when in the closed position, modulation depth of the generated audio signal can be substantially improved or otherwise varied.

The foregoing detailed description has set forth various embodiments of the devices and/or processes via the use of block diagrams, flowcharts, and/or examples. Insofar as such block diagrams, flowcharts, and/or examples contain one or more functions and/or operations, each function and/or operation within such block diagrams, flowcharts, or examples can be implemented, individually and/or collectively, by a wide range of hardware, software, firmware, or virtually any combination thereof. In one embodiment, several portions of the subject matter described herein may be implemented via Application Specific Integrated Circuits (ASICs), Field Programmable Gate Arrays (FPGAs), digital signal processors (DSPs), or other integrated formats. However, some aspects of the embodiments disclosed herein, in whole or in part, can be equivalently implemented in integrated circuits, as one or more computer programs running on one or more computers (e.g., as one or more programs running on one or more computer systems), as one or more programs running on one or more processors (e.g., as one or more programs running on one or more microprocessors), as firmware, or as virtually any combination thereof, and that designing the circuitry and/or writing the code for the software and or firmware would be well within the skill of one of skill in the art in light of this disclosure. In addition, the mechanisms of the subject matter described herein are capable of being distributed as a program product in a variety of forms, and that an illustrative embodiment of the subject matter described herein applies regardless of the particular type of signal bearing medium used to actually carry out the distribution. Examples of a signal bearing medium include, but are not limited to, the following: a recordable type medium such as a floppy disk, a hard disk drive, a Compact Disc (CD), a Digital Video Disk (DVD), a digital tape, a computer memory, etc.; and a transmission type medium such as a digital and/or an analog communication medium (e.g., a fiber optic cable, a waveguide, a wired communications link, a wireless communication link, etc.).

Those skilled in the art will recognize that it is common within the art to describe devices and/or processes in the fashion set forth herein, and thereafter use engineering practices to integrate such described devices and/or processes into data processing systems. That is, at least a portion of the devices and/or processes described herein can be integrated into a data processing system via a reasonable amount of experimentation. Those having skill in the art will recognize that a typical data processing system generally includes one or more of a system unit housing, a video display device, a memory such as volatile and non-volatile memory, processors such as microprocessors and digital signal processors, computational entities such as operating systems, drivers, graphical user interfaces, and applications programs, one or more interaction devices, such as a touch pad or screen, and/or control systems including feedback loops and control motors (e.g., feedback for sensing position and/or velocity; control motors for moving and/or adjusting components and/or quantities). A typical data processing system may be implemented utilizing any suitable commercially available components, such as those typically found in data computing/communication and/or network computing/communication systems.

The herein described subject matter sometimes illustrates different components contained within, or connected with, different other components. It is to be understood that such depicted architectures are merely exemplary, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected", or "operably coupled", to each other to achieve the desired functionality, and any two components capable of being so associated can also be viewed as being "operably couplable", to each other to achieve the desired functionality. Specific examples of operably couplable include but are not limited to physically mateable and/or physically interacting components and/or wirelessly interactable and/or wirelessly interacting components and/or logically interacting and/or logically interactable components.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

I claim:

1. A speaker device, comprising:

a planar oscillation element configured to generate an ultrasonic acoustic signal in a direction orthogonal to a surface of the planar oscillation element;

a shutter element configured to alternatively obscure and reveal an aperture positioned to receive the ultrasonic acoustic signal;

a blind element wherein the aperture is formed in the blind element, and wherein the blind element is separated from the shutter element by a gap: and a controller coupled to the shutter element and configured to displace the shutter element to alternately obscure and reveal the aperture, in response to an application of a modulation signal to the shutter element, wherein the shutter element is further configured to modulate the ultrasonic, acoustic signal to generate an audio signal in response to the shutter element being displaced, wherein a portion of the shutter element is configured to obscure the aperture by overlap of a distance that is equal to or greater than the gap, and wherein the portion of the shutter element is larger than the aperture.

2. The speaker device of claim 1, wherein the planar oscillation element comprises a membrane configured to remain substantially stationary with respect to adjacent elements of the speaker devices.

3. The speaker device of claim 2, wherein the membrane, comprises one of a piezoelectric transducer or a semiconductor thin films.

4. The speaker device of claim 1, wherein the shutter element is positioned substantially parallel to the surface of the planar oscillation element.

5. The speaker device of claim 1, wherein the blind element is disposed between the planar oscillation element and the shutter element.

6. The speaker device of claim 1, wherein the blind element includes a plurality of apertures, wherein the shutter element is configured with a plurality of portions, and wherein each of the plurality of portions is configured to obscure a corresponding aperture of the plurality of apertures.

7. The speaker device of claim 6, wherein each of the plurality of portions is larger than the corresponding aperture that the portion is configured to obscure.

8. The speaker device of claim 1, wherein the blind element is substantially parallel to the shutter element.

9. The speaker device of claim 1, wherein the portion is configured to completely obscure the aperture by overlap of all edges of the aperture.

10. The speaker device of claim 9, wherein the portion is configured to overlap the edges of the aperture by the distance that is equal to or greater than the gap disposed between the blind element and the shutter element.

11. The speaker device of claim 1, wherein the shutter element is configured to move substantially perpendicular to the direction to modulate the ultrasonic acoustic signal.

12. The speaker device of claim 1, wherein the controller is configured to displace the shutter element at a particular frequency to modulate the ultrasonic acoustic signal.

13. The speaker device of claim 12, wherein a frequency of the audio signal is substantially equal to a difference between the particular frequency and a frequency of the planar oscillation element that is used to generate the ultrasonic acoustic signal.

14. The speaker device of claim 1, wherein the shutter element is configured to alternately obscure and reveal the aperture at a frequency of at least about 50 kHz.

15. The speaker device of claim 1, wherein the aperture has a width that is less than about 100 microns.

16. A method to generate an audio signal, the method comprising:

generating an ultrasonic acoustic signal with a planar oscillation element of a microelectromechanical system (MEMS) speaker;

directing the ultrasonic acoustic signal through an aperture positioned to receive the ultrasonic acoustic signal; and modulating the ultrasonic acoustic signal to generate the audio signal by alternately obscuring and revealing the aperture using a shutter element of the MEMS speaker, wherein the aperture is formed in a blind element, and wherein the blind element is separated from the shutter element by a gap, wherein the shutter element includes a portion configured to obscure the aperture by overlapping the aperture by a distance that is equal to or greater than the gap, and wherein the portion of the shutter element is larger than the aperture.

17. The method of claim 16, wherein directing the ultrasonic acoustic signal through the aperture positioned to receive the ultrasonic acoustic signal comprises directing the ultrasonic acoustic signal through a plurality of apertures positioned to receive the ultrasonic acoustic signal.

18. The method of claim 17, wherein modulating the ultrasonic acoustic signal to generate the audio signal by alternately obscuring and revealing the aperture using the shutter element comprises modulating the ultrasonic acoustic signal using the shutter element that comprises a plurality of portions that are each configured to obscure a corresponding one of the plurality of apertures, and wherein each portion of the plurality of portions is larger than the corresponding one of the plurality of apertures.

19. The method of claim 16, wherein the blind element is substantially parallel to the, shutter element, and wherein the overlapped distance is selected to vary a modulation depth of the audio signal.

20. A speaker device to generate an audio signal, the speaker device comprising:

a planar oscillation element configured to generate an ultrasonic acoustic signal in a direction orthogonal to a surface of the planar oscillation element; and, a shutter element configured to alternatively obscure and reveal an aperture positioned to receive the ultrasonic acoustic wherein the aperture is formed in a blind element, wherein the blind element is substantially parallel to the shutter element and is separated from the shutter element by a gap, wherein the shutter element is configured to modulate the ultrasonic acoustic signal to generate the audio signal, wherein the shutter element comprises a portion larger than the aperture, wherein the portion is configured to completely obscure the aperture by overlap of a distance that is equal to or greater than the gap, and wherein the overlapped distance is selected to vary a modulation depth of the audio signal.

* * * * *